US006044758A

United States Patent [19]

Drake

[11] Patent Number: 6,044,758

[45] Date of Patent: Apr. 4, 2000

[54] CONFIGURABLE LAP DESK

[76] Inventor: David C. Drake, 10050 E. 6th St., Unit F, Rancho Cucamonga, Calif. 91730

[21] Appl. No.: 09/189,231

[22] Filed: Nov. 8, 1998

Related U.S. Application Data

[60] Provisional application No. 60/064,967, Nov. 8, 1997.

[51] Int. Cl.[7] ..... A47B 23/00

[52] U.S. Cl. ..... 100/43; 248/444

[58] Field of Search ..... 108/43, 115, 6, 108/25, 26, 44, 45, 49; 248/460, 463, 459, 444, 454, 453

[56] References Cited

U.S. PATENT DOCUMENTS

| | | | |
|---|---|---|---|
| 1,869,278 | 7/1932 | Ramelli | 248/455 |
| 1,947,053 | 2/1934 | Mason | 248/460 X |
| 2,054,098 | 9/1936 | Rich | 248/444 |
| 3,709,158 | 1/1973 | Kidd | 108/43 |
| 4,592,285 | 6/1986 | Egli | 248/455 X |
| 5,255,612 | 10/1993 | Anderson | 108/43 |
| 5,598,786 | 2/1997 | Patterson | 108/43 |
| 5,692,719 | 12/1997 | Shepherd | 248/460 |

FOREIGN PATENT DOCUMENTS

| | | | |
|---|---|---|---|
| 263452 | 12/1926 | United Kingdom | 108/43 |

*Primary Examiner*—Jose V. Chen

[57] ABSTRACT

A desk unit is presented which is adaptable for multiple convenient and effective uses by a user in seated or reclining position by placing the desk over the user's lap. The desk is fully portable and foldable, yet light weight and sufficiently sturdy to support a laptop computer, large book, art supplies, eating vessels, or even a complete newspaper in vertical position with the aid of the included clip. The desk is comprised principally of a table surface, hingable ledge, hingeable working surface lid, and foldable legs. The lid is fixed in angular position by adjustable brackets to best present the contained objects to the user, and a variety of convenience features may be built into the unit such as compartments for containment of writing instruments and height adjustable legs.

8 Claims, 3 Drawing Sheets

FIG. 3
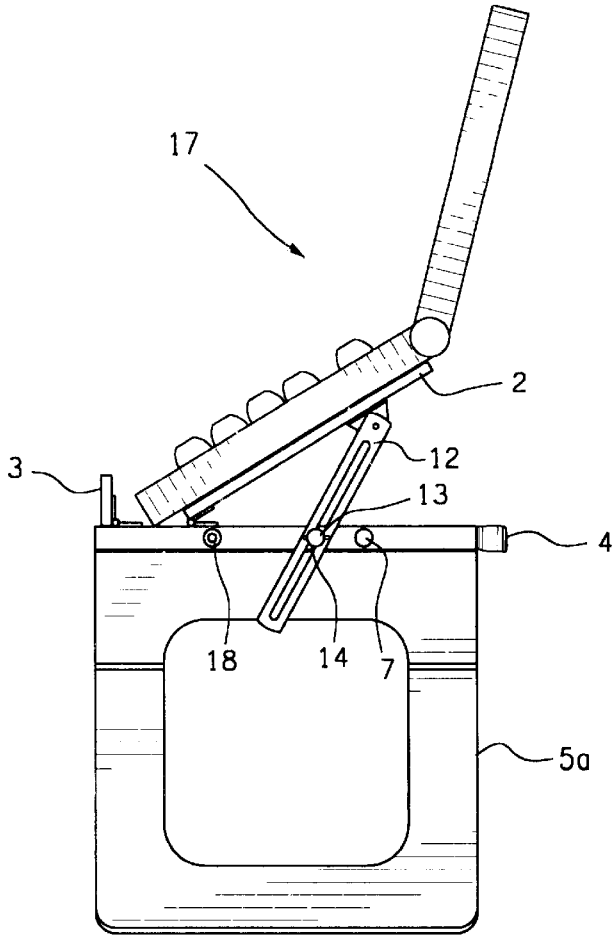
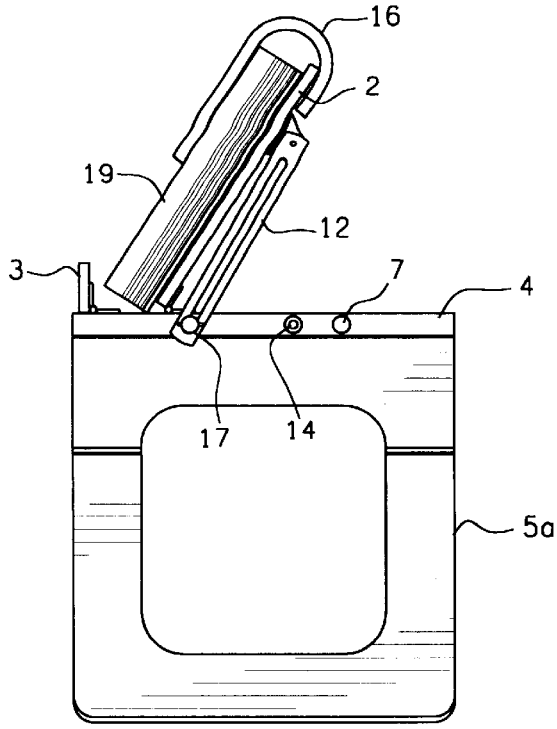
FIG. 4

FIG. 5
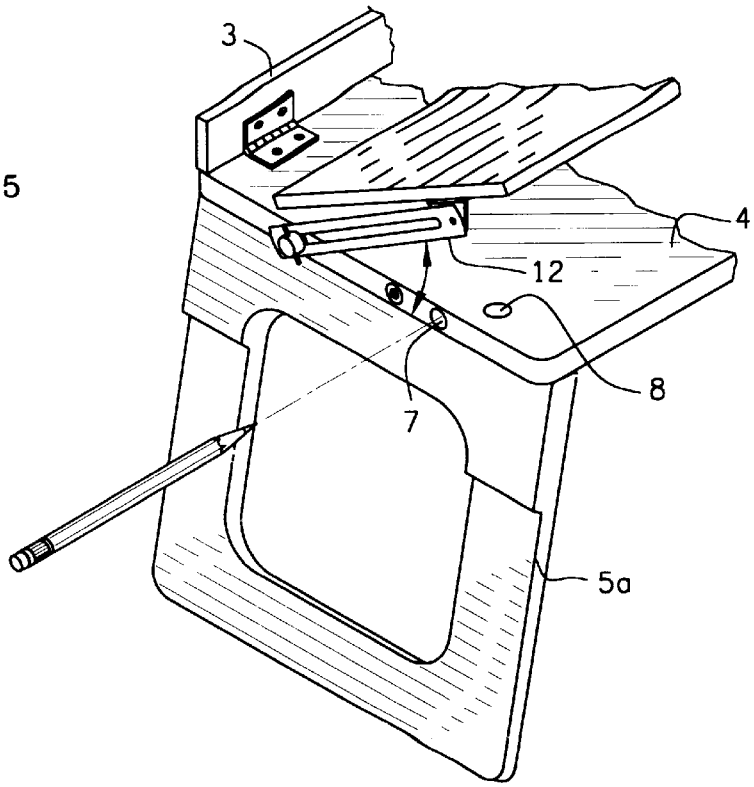
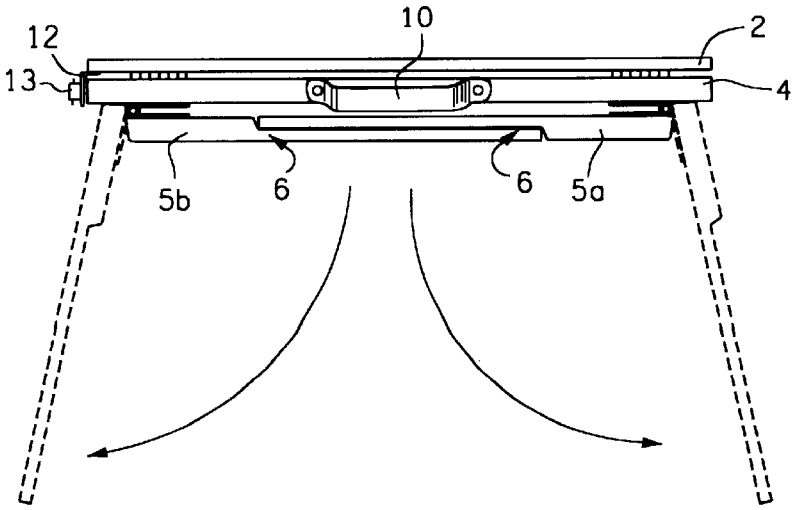
FIG. 6

CONFIGURABLE LAP DESK

This is a continuation of U.S. Ser. No. 60/064,967 (PPA) filed Nov. 8, 1997.

BACKGROUND OF THE INVENTION

The computer age has imposed various ergonomic problems and requirements on the population of workers and students that grow as the character of newly developed machine and accessories multiply. In particular, the development of portable computers poses problems of placement of the machines for comfortable, efficient and safe operation. The increase in carpal tunnel syndrome is a symptom of improper keyboard placement and operation which can be prevented or eased by aids that will support and present the computer in anatomically correct relationship to the user's hand, wrist and arm placement. This problem is the primary motivator for development of the within described invention, which consists of an adjustable desk for use of a portable computer in a variety of environments.

Such an adjustable desk can be used for a number of other containment and presentation functions if it can be designed to be adjustable for other equipment and purposes. Therefore maximum adjustability within the constraint of being fully portable is a secondary, but still important, design criterion of the within invention.

1. Field of the Invention

This invention is within the field of portable lap desks and trays.

2. Description of the Related Art

Other products have long been presented as lap desks for use in a seated or reclining position, such as breakfast trays, bean bag pillows with plastic tops, book frames and lap writing desks with legs or other supports. All of these are relatively inadaptable for other than single uses and none are well-adapted for use with a portable computer.

BRIEF SUMMARY OF THE INVENTION

First, this device is designed for use while a person is in a physical state of resting, as they will be able to retain more and perform better while performing intellectual endeavors in comfort. This invention allows hands-free reading because it holds a books binder and pages for a person while they rest in virtually any position and anywhere. In medical environments, the device allows a bed-confined person to read, write, type(with a computer keyboard/laptop). Further, an able-bodied person can use the device to additionally draw, paint, craft, eat, or make presentations, while sitting, standing, or laying down, on a sofa, chair, plane, train, car, bus, boat, floor, table, or bed.

As it is designed to be used comfortably anywhere and adjustable to any situation of use, the invention must be and is foldable and portable, adjustable for support of a computer, book, writing materials, or plates of food and eating utensils. The unit further should be dimensioned to fit over the user's lap in seated or reclining position without touching hips or torso. Since reading will frequently be the activity in which the device is used, it should hold a book's pages in place, which it does through the use of the hinged ledge that is adjustable and closes in on the margins of reading material of varying thickness. This ledge can be positioned 0–90 degrees and provides an ergonomic wrist support for computer users while working, and simultaneously acts with the lid to divert the heat of a laptop computer away from a persons body. It also hides a pen via a pen-hole inside the edge of the top, and in the lid down position, the lid support hinge locks the pen in place by covering the hole. Thus the device serves in many ways as a filly functional miniature portable desk, combining the portability of a tool, an adjustable desktop book holder, table, tray, desk, lectern, keyboard/laptop computer holder with wrist-ledge, easel, bookstand, cookbook holder, book ends, pen holder, and music stand all within one product fashioned as a fine piece of furniture.

BRIEF DESCRIPTION OF THE DRAWINGS

FIG. 3 is a side view of the configurable lap desk in operational position with a portable computer in place on the lid.

FIG. 4 is a side view of the configurable lap desk in operational position with a book clipped to the raised lid.

FIG. 5 is a partial view of a portion of the lid, showing the penhole and the lid bracket swinging into position to cover and close the hole.

FIG. 6 is a back view of the configurable lap desk with eht lid closed and the legs folded and nested (legs shown unfolded in phantom view).

DETAILED DESCRIPTION OF THE INVENTION

Figure 1:
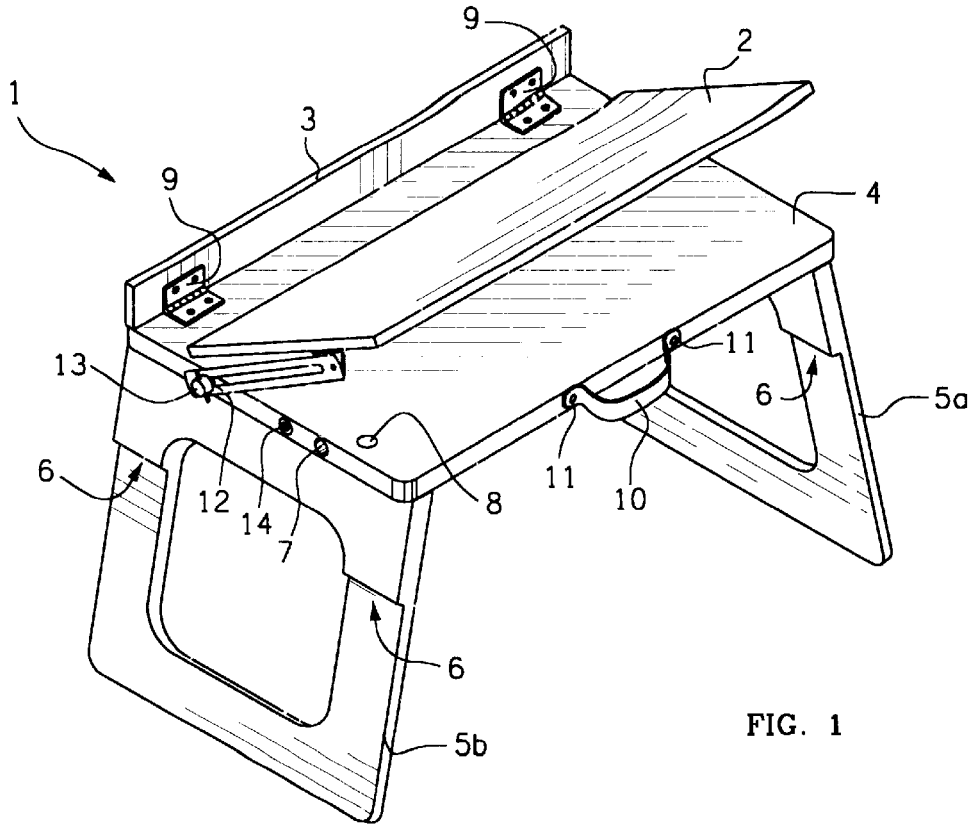
FIG. 1 is a perspective view of the configurable lap desk in operational position with the lid partly raised and locked into position.

Turning now to FIG. 1, the invention is illustrated in perspective view as a table 1 constructed as a folding lap desk, with working surface lid 1 hinged to base 4. Ledge 3 is also hinged to base 4 by hinges 9, and legs 5*a* and 5*b* are hinged to swing and fold together inwardly on the bottom surface of base 4. It may here be seen that the ledge 3 and the lid 2 may be adjusted for various purposes through a range of 0–90 degrees relative to the base, and the lid is held adjustably in place by brass bracket 12 which is in turn locked in place by t-knob 13 which screws into a threaded anchor set into the edge of the base 4. Note that the anchor into which the knob is screwed in this view is hidden, but another anchor insert 14 is positioned rearward of the first anchor for use in certain positional adjustments. Also visible on this edge of base 4 is a pen-containing hole 7 which is provided to conveniently retain a pen or pencil for ready use.

Note that the base 4 is the most extensive and substantial piece of the unit, typically constructed of high-quality dense plywood or hardwood, which provides stiffness and weight stability to the unit, as lighter weight or less rigid types of lap desk would not sufficiently support the weight of electronic equipment such as a laptop computer or provide the necessary stability of a low center of gravity.

Other parts visible in the view of FIG. 1 are the ledge 6 which is provided on only one leg and which nests with the opposite leg when the legs are in folded portable position, and leather or fabric handle 10 held in place at the rearward edge of base 4 by rivets 11. Note also that ledge hinges 9 are slightly offset or pigeon-toed to provide tensioning as the ledge is raised and tending to keep the ledge in the set angular position. As the lid and other parts are designed to fold against the base for portability, several tack bumpers S of felt or rubber are provided to cushion the parts from complete contact during transport.

Figure 2:
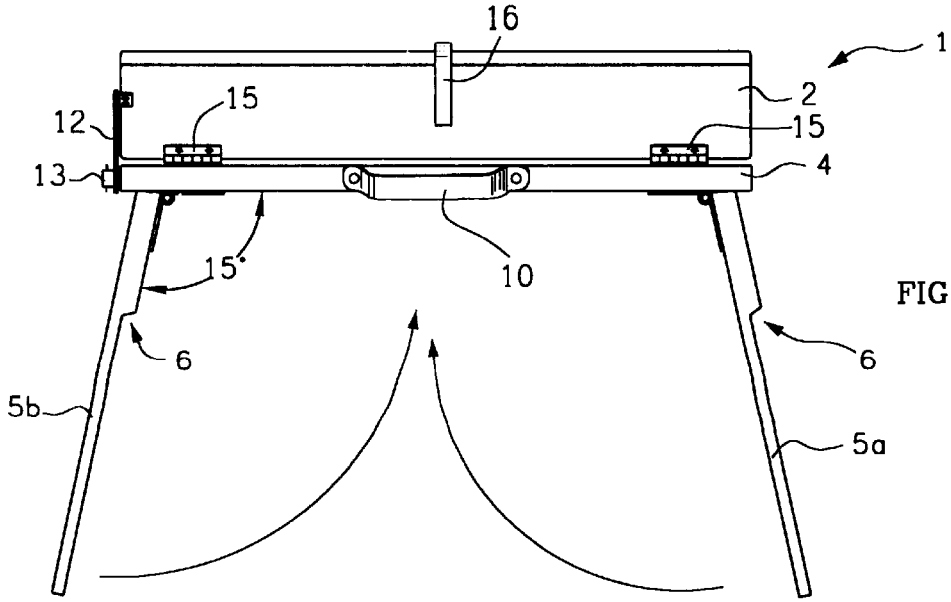
FIG. 2 is a front view of the configurable lap desk in operational position with the lid raised to book support position, and noting that the hinged legs may be folded mw aid to nested portable position.

FIG. 2 illustrates in a front view the device in extended operational position with the lid 2 raised to a more vertical position for supporting papers or books for reading or drawing purposes. Hinges 15 are provided to move lid 2 supportedly through its range of adjustment. Brass clip 16 is provided to retain the book or papers in place in a nearly vertical position for hands-free reading or for remote use such as for a cookbook holder in a kitchen environment or as a portable lectern for holding speech notes or as a music stand. It may also be seen that the normal extended position of the legs 5*a* and 5*b* are set outwardly at about 15 degrees and hinged to swing inwardly to closed portable position. It may also be seen by projecting the legs to closed position that the build-up step 6 will enable the leg 5*b* to close over and lay parallel to leg Sa, and that in folded position with the lid closed against the base, the entire unit is configured for portability in the approximate shape of a briefcase and may be conveniently transported by means of handle 10. The legs are cutout as shown to reduce weight of the unit and for comfort, access, heat buildup reduction, and aesthetics of the design.

FIG. 3 is a side view of the lap desk device configured to support a laptop computer 17 in operating position, presented to the user in seated or reclining position in the optimally adjusted angular position for comfort and ergonomically correct operation. Note here that the lid bracket 12 has been removed from the forward anchor insert 18 and placed over the rearward anchor insert 14, with the t-knob 13 ready to be lowered into position to screw into insert 14. This positions the lid such that the repositioned bracket may support more weight applied at the rearward section of the lid 2.

By contrast, in FIG. 4 the lid 2 is raised into vertical position for holding book 19 for comfortable reading by the user, and the bracket 12 has been moved back for connection to forward anchor insert 17 to thus support the lid forwardly. Clip 16 is also seen in this view to be u-shaped and clipped over the book to affix it to the raised lid 2.

FIG. 5 shows that the pen hole 7 set into the edge of base 4 (the hidden view lines indicating that the hole extends about the typical length of a writing instrument into the material of the base edgewise), and that the lid bracket 12, as it is moved downwardly with the folding of the lid to closed position, will thus cover the hole and lock the enclosed pencil in place while the entire unit is transported.

FIG. 6 illustrates the bed desk from the back in closed position, ready for transport or storage. Here it can be clearly seen that the nesting configuration of the legs enables a tightly folded arrangement, in that each leg is stepped such that they may overlap in parallel when placed together and thus lay flat. The stepped structure of the legs (more clearly shown in the phantom view of the legs in extended position) provides thicker material support at the top of the leg where hinged to the desk itself, and a thinner portion at the stepped lower portion to minimize material and reduce overall unit weight.

The stepped construction also offers opportunity for height adjustability of the legs, as the thicker portion can be reconfigures to accept a separate thinner stepped lower portion with appropriate mating grooves and releasable attachments such as wingnuts to adjust the leg height by changing relative positions of upper and lower leg portions.

Note also in the various views that the ledge is necessarily configured such that contained objects, equipment and materials do not fall into the user's lap, and can be adjusted to a wide range of appropriate angles to do so. It may also be pressed inwardly toward contained material such as books or papers to securely contain them and the tensioning function of the hinges will aid this function and tend to retain the ledge in the position to which it is placed.

The same ledge also creates an adjustable channel for writing and drawing utensils, instruments, supplies.

Not seen in the views is the fact that the lid 2 overhangs base 4 by a small dimension, typically ⅛ inch, such that the lid may more easily be fingered and lifted into position, particularly by persons of limited dexterity or disability. Of course, the overhang could be reversed easily by reversing the attachment of the lid for right- or left-handed persons.

Also not apparent from the drawings or discussion above is that the unit may be reconfigured or positioned for a variety of unexpected additional uses and applications by reason of its variability and adaptability of its design. For instance, by turning the unit upside down with lid folded but legs extended it may function as a temporary bookshelf with the legs serving as bookends. Even more imaginatively, the unit may be hung on a wall hook by its handle 10 and serve as a magazine rack by extending ledge 3 only, with the lid and legs remaining folded. Of course, its uses in various table top applications, such as for vanity table with cosmetics tray, a bed service tray, or TV table are also within its range of configurations.

Thus it may be seen that the expressed objectives and many more are achieved by the within invention.

What is claimed is:

1. A configurable lap desk comprising;

A table of generally rectangular form and composed of sheet material having a thickness, a top side, a bottom side, a front edge, a back edge, and right side edge and a left side edge, a ledge hingably attached to fold flat against said table surface and fold upwardly from said surface adjacent said front edge, said ledge extending substantially the entire length of said front edge, a lid surface adjacent to and covering substantially all of the table top side except for the portion covered by said ledge, said lid hingably attached at its edge nearest said table surface front edge such that the lid may be moved to an angular position within a range of angular positions with respect to said table, said lid supported by at least one adjustable bracket affixed between one side edge of said table and one side edge of said lid, the length of said bracket being a limit on said range of angular positions of said lid with respect to said table, means for locking said bracket at a selected angular position, and two legs of generally rectangular shape foldably hinged to the bottom side of said table near said right and left edges of said table.

2. The lap desk of claim 1 further comprising a handle affixed to one edge of said table.

3. The lap desk of claim 1 further comprising a compartment shaped to contain a writing instrument, said compartment being formed by drilling into an edge of said table thickness at a location where the opening of said compartment is covered by said bracket attached to said table and said lid when the lid and table are in closed adjacent position relative to each other.

4. The lap desk of claim 1 further comprising securing means for fixing the angular relationship of said table and said lid.

5. The lap desk of claim 4 wherein the securing means is a set screw set into a slot in said adjustable bracket and a screw anchor set into the adjacent edge of said table.

6. The lap desk of claim 1 further comprising a clip for securing objects to said lid such that the object is presented for viewing by the user when the lap desk is in position over the user's lap.

7. The lap desk of claim 1 wherein said legs are comprised of planar material having a thickness, said thickness of each leg being selectively milled away such that said legs will nest interlockingly when folded together.

8. The lap desk of claim 1 wherein the weight of said desk is reduced by cutting away interior material of said legs leaving a rectangular doughnut shape.

* * * * *